US009419383B1

(12) United States Patent
Zhang

(10) Patent No.: US 9,419,383 B1
(45) Date of Patent: Aug. 16, 2016

(54) SIDE-OPEN MULTIMEDIA INTERFACE HAVING A PLURALITY COMPONENTS IN A PLASTIC SHELL SURROUNDED BY A METALLIC SHELL

(71) Applicant: Amphenol East Asia Electronic Technology (Shen Zhen) Co., Ltd., Shenzhen (CN)

(72) Inventor: Zhiqiang Zhang, Shenzhen (CN)

(73) Assignee: AMPHENOL EAST ASIA ELECTRONIC TECHNOLOGY (SHEN ZHEN) CO., LTD., Shenzhen (CN)

( * ) Notice: Subject to any disclaimer, the term of this patent is extended or adjusted under 35 U.S.C. 154(b) by 0 days.

(21) Appl. No.: 14/813,407

(22) Filed: Jul. 30, 2015

(51) Int. Cl.
*H01R 13/648* (2006.01)
*H01R 13/6581* (2011.01)
*H01R 13/506* (2006.01)
*H01R 13/6593* (2011.01)

(52) U.S. Cl.
CPC ..... *H01R 13/6581* (2013.01); *H01R 13/506* (2013.01); *H01R 13/6593* (2013.01)

(58) Field of Classification Search
CPC ..... H01R 13/648; H01R 13/658; H01R 13/65802; H01R 13/6588; H01R 13/659; H01R 13/6593
USPC ..... 439/607.01–607.51
See application file for complete search history.

(56) References Cited

U.S. PATENT DOCUMENTS 5,664,968 A * 9/1997 Mickievicz ..... H01R 23/688 439/607.1
6,461,202 B2 * 10/2002 Kline ..... H01R 23/688 439/607.05
6,899,566 B2 * 5/2005 Kline ..... H01R 13/514 439/108
7,762,846 B1 * 7/2010 Whiteman, Jr. ..... H01R 13/514 439/607.1
8,512,076 B2 * 8/2013 Zhang ..... H01R 13/6596 439/607.23
2011/0053415 A1 * 3/2011 Fonteneau ..... H05K 9/0058 439/607.01
2011/0143591 A1 * 6/2011 Davis ..... H01R 12/724 439/607.27
2012/0129397 A1 * 5/2012 Chen ..... H01R 13/514 439/607.24

* cited by examiner

*Primary Examiner* — Chandrika Prasad
(74) *Attorney, Agent, or Firm* — Dilworth & Barrese, LLP.

(57) ABSTRACT

The present application specifically relates to a side-open vertical compound high-definition multimedia interface, which includes more than one components and a shell assembly. Each component includes a terminal part and a sub-shell part. The shell assembly includes an upper metal cap, a main plastic shell and a main metal shell, the main plastic shell includes cavities used for containing the components. The component is formed by assembling the terminal part and the sub-shell part together. The number of the cavities is three or more, which are side-openly and vertically provided in the main plastic shell in a parallel manner. Each component can be inserted into one cavity. The main metal shell covers and snaps to the side and bottom portions of the main plastic shell. The advantageous effects of the present invention include: the interface is a compound connector having three or more cavities for containing the components, which could provide the customers with a plurality of connecting ports and thus more choices. At the same time, the interface is featured by anti-vibration, impact-resistance and excellent anti-EMI effects, etc.

5 Claims, 6 Drawing Sheets

SIDE-OPEN MULTIMEDIA INTERFACE HAVING A PLURALITY COMPONENTS IN A PLASTIC SHELL SURROUNDED BY A METALLIC SHELL

TECHNICAL FIELD

The present application relates to the field of multimedia interface, particularly relates to a side-open vertical compound high-definition multimedia interface.

BACKGROUND OF THE INVENTION

High-Definition Multimedia Interface (HDMI) is the first type of digital interface that is capable of transmitting on a single cable the data of uncompressed full digital high-definition audio of multiple sound-channel as well as smart format data and control command data.

Currently, there are some deficiencies with those high-definition multimedia interfaces of A type (HDMI A TYPE) available in the market. Specifically, this kind of product is usually of single interface type or two-layer interface type. However, with increasing demands of the customers, the need for an interface which can provide a greater number of connectors is on the rise.

SUMMARY OF THE INVENTION

The present invention aims at providing a high-definition multimedia interface, which is able to effectively protect the transmission of such signals as videos and audios, and is also featured by compact structure, anti-vibration, impact-resistance and sound anti-EMI effects as well as easy installation and maintenance.

In order to solve the above mentioned problem, the present application provides the following solution. A side-open vertical compound high-definition multimedia interface includes more than one components and a shell assembly, each component includes a terminal part and a sub-shell part, the shell assembly includes an upper metal cap, a main plastic shell and a main metal shell. The component is formed by assembling the terminal part and the sub-shell part together. The sub-shell part is made of iron. The upper metal cap snaps firmly to the upper portion of the main plastic shell. The main plastic shell includes more than one cavities used for receiving the components. The number of the cavities is three or more, which are side-openly and vertically provided in the main plastic shell in a parallel manner. Each component can be inserted into one cavity. The main metal shell covers and snaps to the side and bottom portions of the main plastic shell.

In a preferred technical solution, the main metal shell includes more than one resilient guide tabs which could contact and guide the bottom portion of the sub-shell part.

In a preferred technical solution, the terminal part includes a terminal A and a terminal B, the terminal A and terminal B each includes more than one short terminals, more than one long terminals and more than one bridges, each short terminal includes a fish-eye portion, the sub-shell part includes an inner part, an outer shell and a back shell, the inner part includes an part A and a part B, the short terminals and the long terminals are respectively positioned at one end and the other of both the terminal A and the terminal B, and there are one more terminal in terminal A than in terminal B. The bridges are transversely provided between the terminals of the terminal part. The fish-eye portion is a hollow structure in the middle of the short terminal. The terminal A and the terminal B are respectively inserted into the part A and the part B, then the part A and the part B can snap to one another along their inner sides, forming an assembled inner part. Further, the assembled inner part is inserted into the outer shell. The back shell can be assembled to the back end of the outer shell, accommodating the assembled inner part between them.

In a preferred technical solution, the part A and the part B each includes more than one plastic ribs, when the terminal part is inserted into the inner part, the plastic ribs support the root portions of the short terminals respectively.

With the above mentioned technical solutions, the present invention could achieve the following advantageous effects. Firstly, the interface possesses the characteristics of compact structure and small size. Specifically, the interface is a compound one having three or more cavities for containing the components, each cavity can be inserted with a component (a one-piece connector), providing the customers with a plurality of connecting ports and thus more choices. Secondly, the interface possesses the features of anti-vibration and impact-resistance. Specifically, for one thing, the terminal part has bridges and fish-eye portions, wherein the bridges enhance the strength of the terminals and the fish-eye portions can improve the connecting pressure and the stability of the contact points; for the second, the inner part has plastic ribs which support the root portions of the short terminals respectively when the terminal part is inserted into the inner part, thereby enhancing the strength of the terminals. Thirdly, the interface possesses excellent anti-EMI effects. Specifically, the main metal shell includes resilient guide tabs which can contact and guide the bottom portion of the sub-shell part, thereby effectively resisting EMI.

DETAILED DESCRIPTION OF THE EMBODIMENTS

The present invention will now be described in detail with reference to the specific embodiments, taken in conjunction with FIG. 1 to FIG. 6. However, the description and the figures are not intended to limit the scope of the present application.

Figure 1:
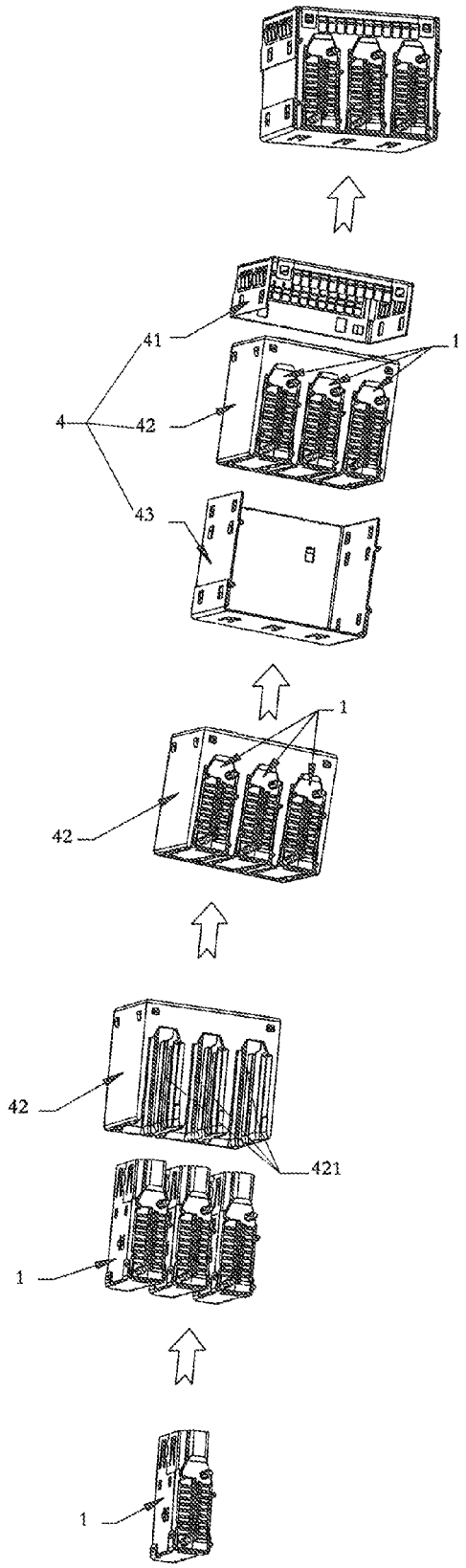
FIG. 1 is a general assembly view of the interface.
Figure 3:
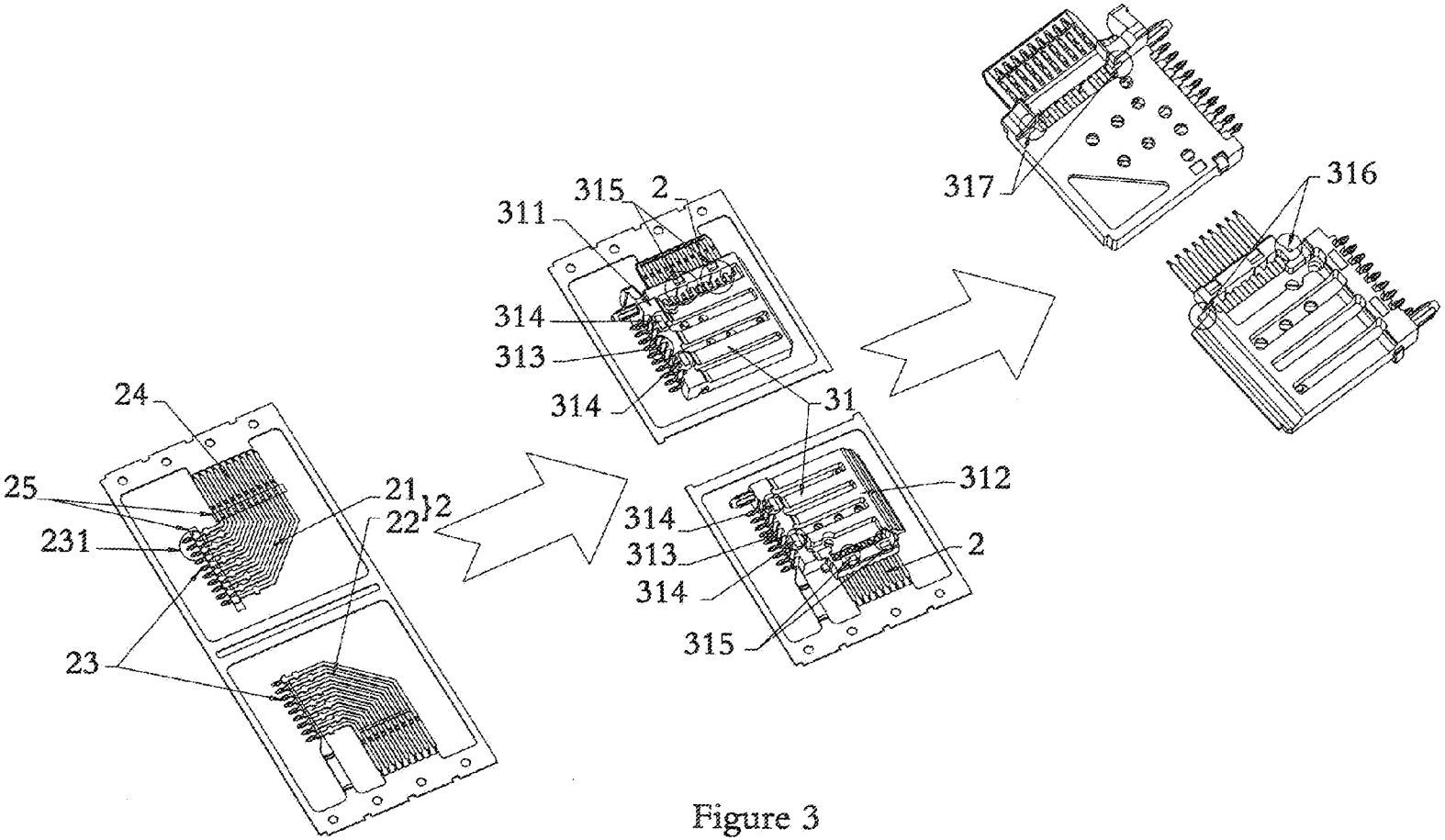
FIG. 3 is an assembly view of a component.
Figure 4:
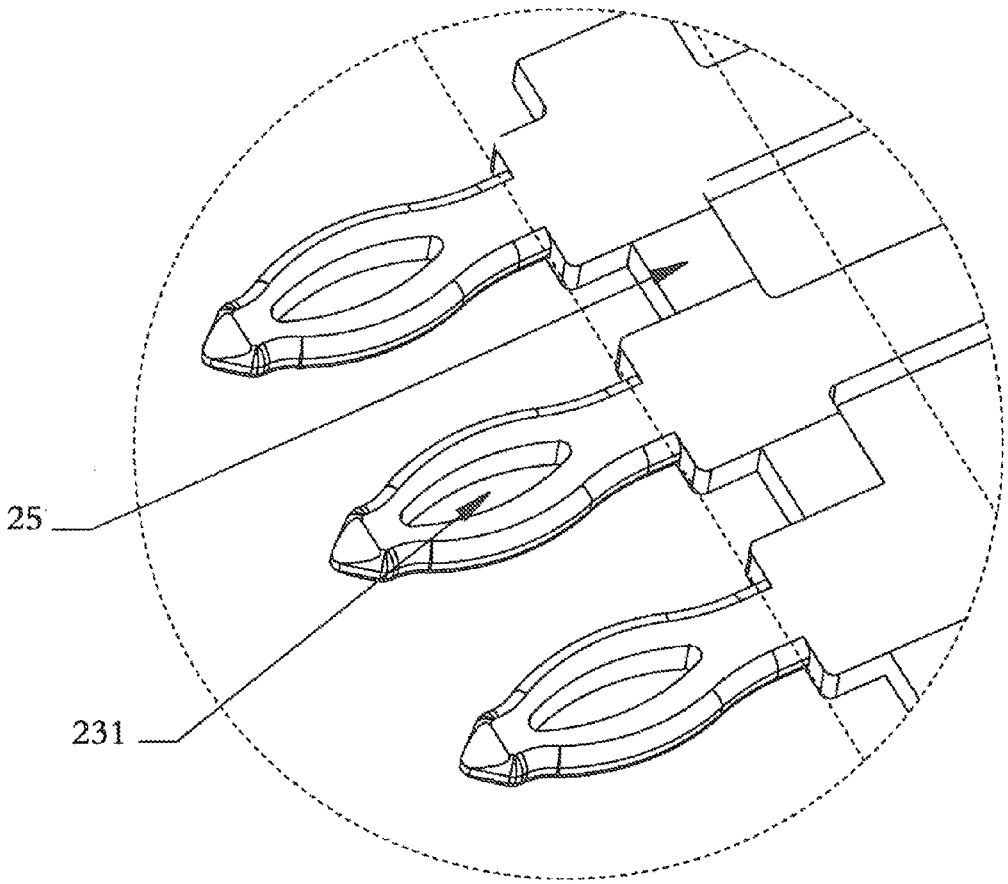
FIG. 4 is an enlarged partial view of the component.

As shown in FIG. 1 and FIG. 3, a side-open vertical compound high-definition multimedia interface comprises more than one components 1 and a shell assembly 4, each component 1 includes a terminal part 2 and a sub-shell part 3, the shell assembly 4 includes an upper metal cap 41, a main plastic shell 42 and a main metal shell 43, the main plastic shell 42 includes cavities 421 which are used for receiving the components 1.

Each component 1 is formed by assembling the terminal part 2 and the sub-shell part 3 together. The sub-shell part 3 is made of iron. The upper metal cap 41 snaps firmly to the upper portion of the main plastic shell 42. The main plastic shell 42 includes more than one cavities 421 which are used for receiving the components 1. There are three cavities 421 which are side-openly and vertically provided in the main plastic shell 42, parallel to each other. Each component 1 can be inserted into one cavity 421. The main metal shell 43 covers and snaps to three side portions and the bottom portion of the main plastic shell 42.

Figure 2:
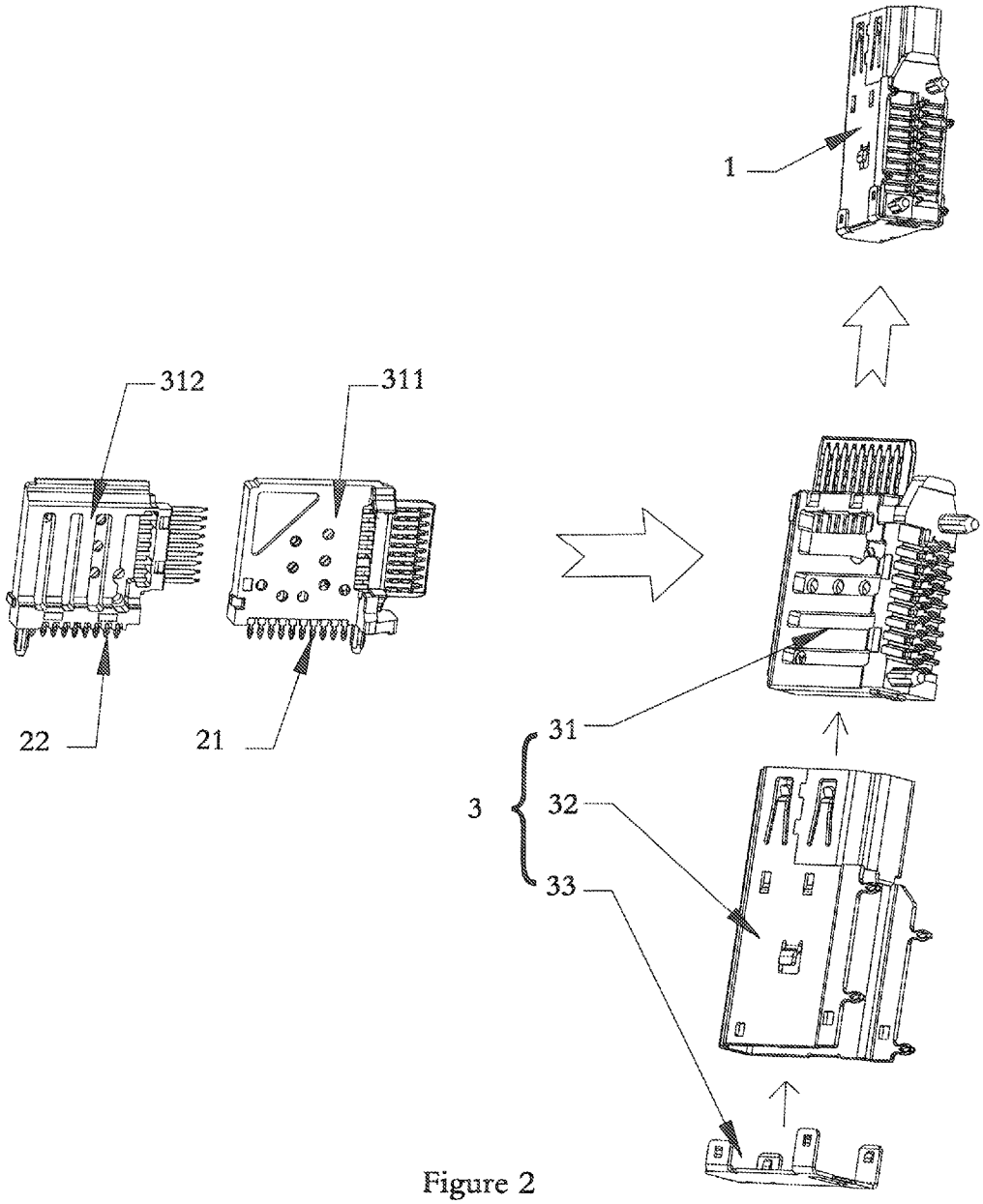
FIG. 2 is a view showing the assembled interface.

As shown in FIG. 2, on the basis of the above described embodiment, the main metal shell 43 includes more than one resilient guide tabs 431 which could contact and guide the bottom portion of the sub-shell part 3.

As shown in FIG. 2, on the basis of the above described embodiments, the upper metal cap 41 includes more than one anti-cracking holes 411 which are evenly provided on the side faces of the upper metal cap 41.

As shown in FIG. 3 to FIG. 6, on the basis of the above described embodiments, the terminal part 2 includes a terminal A 21 and a terminal B 22, the terminal A 21 and terminal B 22 each includes more than one short terminals 23, more than one long terminals 24 and more than one bridges 25, each short terminal 23 includes a fish-eye portion 231. The sub-shell part 3 includes an inner part 31, an outer shell 32 and a back shell 33, the inner part 31 further includes a part A 311 and a part B 312. The short terminals 23 and the long terminals 24 are respectively positioned at one end and the other of the terminal A 21 and the terminal B 22, and there are one more terminal in terminal A 21 than in terminal B 22. The bridges 25 are transversely provided between the short terminals 23 of the terminal part 2. The fish-eye portion 231 is a hollow structure in the middle of the short terminal 23. The terminal A 21 and the terminal B 22 are respectively inserted into the part A 311 and the part B 312, then the part A 311 and the part B 312 can snap to one another along their inner sides, forming an assembled inner part 31. Further, the assembled inner part 31 is inserted into the outer shell 32. The back shell 33 can be assembled to the back end of the outer shell 32, accommodating the assembled inner part 31 between them.

Figure 5:
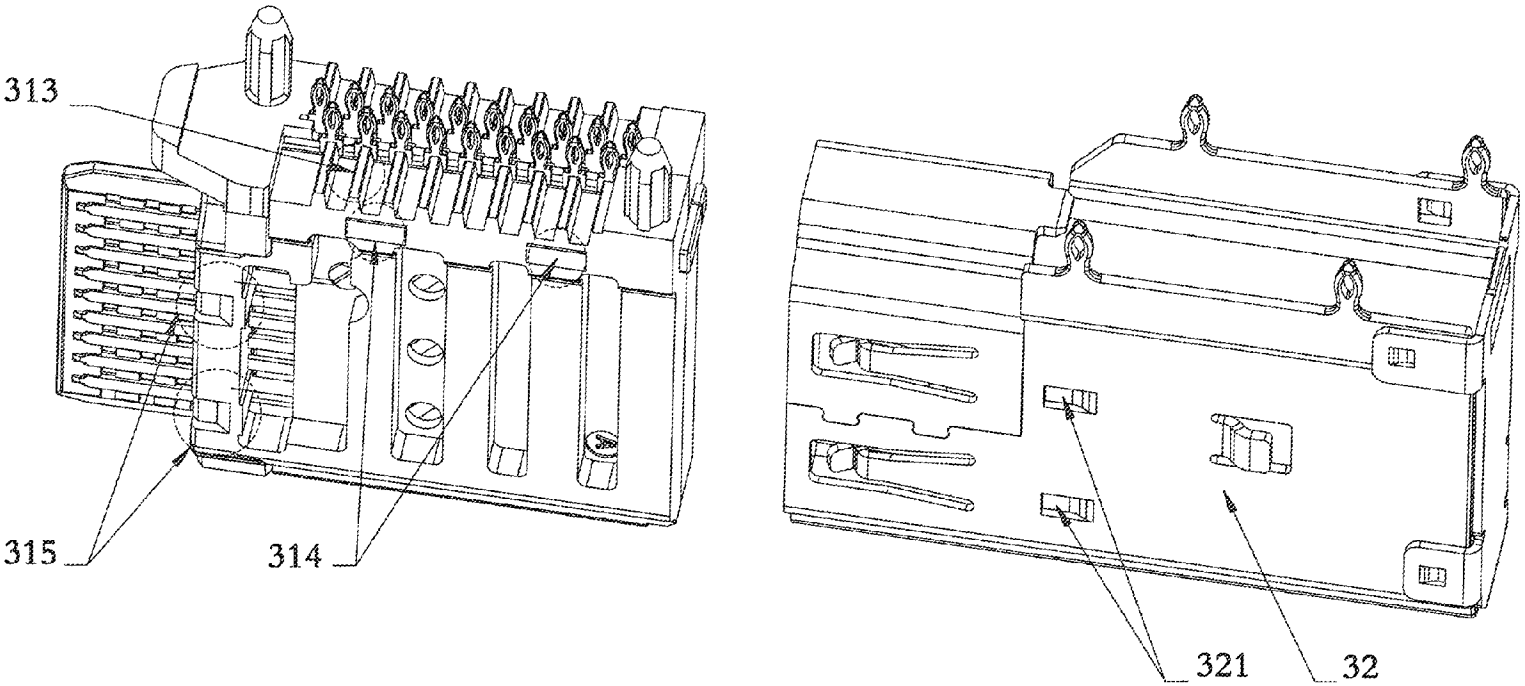
FIG. 5 is a view showing the inner part and the outer shell.

As shown in FIG. 5, on the basis of the above described embodiments, the part A 311 and the part B 312 each includes more than one plastic ribs 313. When the terminal part 2 is inserted into the inner part 31, the plastic ribs 313 support the root portions of the short terminals 23 respectively.

Figure 6:
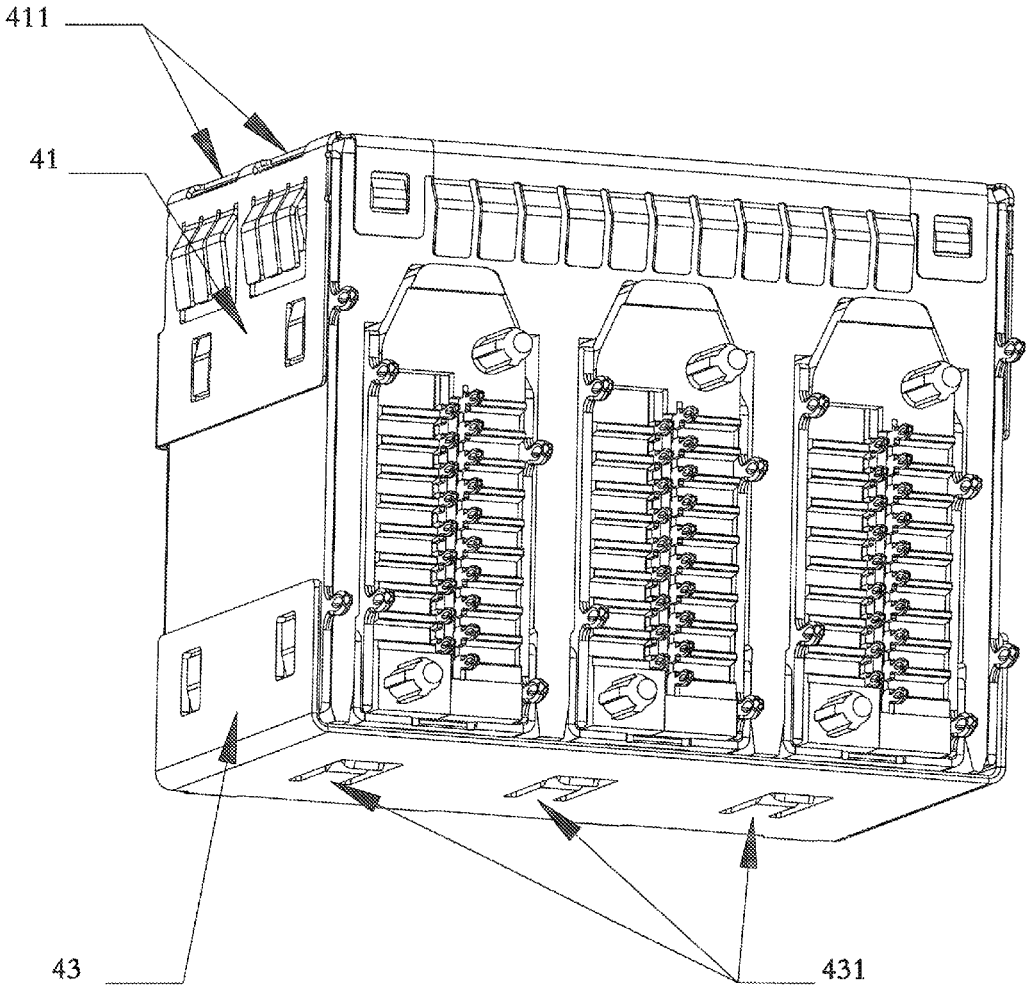
FIG. 6 is an assembly view of the inner part.

As shown in FIG. 5 and FIG. 6, on the basis of the above described embodiments, the part A 311 and the part B 312 each includes more than one outer protrusions 314, the number of which is four or more. When the assembled inner part 31 is inserted into the outer shell 32, the outer protrusions 314 can bear against the inner portion of the outer shell 32.

As shown in FIG. 5, on the basis of the above described embodiments, the part A 311 and the part B 312 each includes outer snap grooves 315, the outer shell 32 includes snap elements 321 which are provided on the inner side of the outer shell 32. When the assembled inner part 31 is inserted into the outer shell 32, each outer snap groove 315 positionally corresponds to and thus snaps to one snap element 321.

As shown in FIG. 6, on the basis of the above described embodiments, the part A 311 and the part B 312 each includes at least one inner snap-in male connector 316 and at least one inner snap-in female connector 317, which are respectively provided on the sides of the part A 311 and part B 312. When the part A 311 is assembled to the part B 312, each inner snap-in male connector 316 positionally corresponds to and thus snaps fit to one inner snap-in female connector 317.

As shown in FIG. 6, the terminal A 21 and the terminal B 22 could be made at the same time with the same set of mold to save cost. The four bridges 25 can enhance the strength of the terminal part 2.

What is claimed is:

1. A side-open vertical compound high-definition multimedia interface, characterized by comprising more than one components (1) and a shell assembly (4), wherein each component (1) includes a terminal part (2) and a sub-shell part (3), the shell assembly (4) includes an upper metal cap (41), a main plastic shell (42) and a main metal shell (43);

each component (1) is formed by assembling the terminal part (2) and the sub-shell part (3) together;

the sub-shell part (3) is made of iron;

the upper metal cap (41) snaps firmly to the upper portion of the main plastic shell (42);

the main plastic shell (42) includes more than one cavities (421) which are used for receiving the components (1);

there are three or more cavities (421) which are side-openly and vertically provided in the main plastic shell (42) in a parallel manner;

each component (I) can be inserted into one cavity (421);

the main metal shell (43) covers and snaps to the side and bottom portions of the main plastic shell (42).

2. The side-open vertical compound high-definition multimedia interface according to claim 1, characterized in that the main metal shell (43) includes more than one resilient guide tabs (431) which could contact and guide the bottom portion of the sub-shell part (3).

3. The side-open vertical compound high-definition multimedia interface according to claim 2, characterized in that the terminal part (2) includes a terminal A (21) and a terminal B (22), the terminal A (21) and terminal B (22) each includes more than one short terminals (23), more than one long terminals (24) and more than one bridges (25), each short terminal (23) includes a fish-eye portion (231), the sub-shell part (3) includes an inner part (31), an outer shell (32) and a back shell (33), the inner part (31) includes a part A (311) and a part B (312), the short terminals (23) and the long terminals (24) are respectively positioned at one end and the other of both the terminal A (21) and the terminal B (22), and there are one more terminal in terminal A (21) than in terminal B (22);

the bridges (25) are transversely provided between the short terminals (23) of the terminal part (2);

the fish-eye portion (231) is a hollow structure in the middle of the short terminal (23);

the terminal A (21) and the terminal B (22) are respectively inserted into the part A (311) and the part B (312), then the part A (311) and the part B (312) can snap to one another along their inner sides, forming an assembled inner part (31);

the assembled inner part (31) is further inserted into the outer shell (32);

the back shell (33) is assembled to the back end of the outer shell (32), accommodating the assembled inner part (31) between them.

4. The side-open vertical compound high-definition multimedia interface according to claim 3, characterized in that, the part A (311) and the part B (312) each includes more than one plastic ribs (313) which support the root portions of the short terminals (23) respectively when the terminal part (2) is inserted into the inner part (31).

5. The side-open vertical compound high-definition multimedia interface according to claim 1, characterized in that the terminal part (2) includes a terminal A (21) and a terminal B (22), the terminal A (21) and terminal B (22) each includes more than one short terminals (23), more than one long terminals (24) and more than one bridges (25), each short terminal (23) includes a fish-eye portion (231), the sub-shell part (3) includes an inner part (31), an outer shell (32) and a back shell (33), the inner part (31) includes a part A (311) and a part B (312), the short terminals (23) and the long terminals (24) are respectively positioned at one end and the other of both the terminal A (21) and the terminal B (22), and there are one more terminal in terminal A (21) than in terminal B (22);

the bridges (25) are transversely provided between the short terminals (23) of the terminal part (2);

the fish-eye portion (231) is a hollow structure in the middle of the short terminal (23);

the terminal A (21) and the terminal B (22) are respectively inserted into the part A (311) and the part B (312), then the part A (311) and the part B (312) can snap to one another along their inner sides, forming an assembled inner part (31);

the assembled inner part (31) is further inserted into the outer shell (32);

the back shell (33) is assembled to the back end of the outer shell (32), accommodating the assembled inner part (31) between them.

* * * * *